US006311619B1

(12) United States Patent
Stamme et al.

(10) Patent No.: US 6,311,619 B1
(45) Date of Patent: Nov. 6, 2001

(54) SHEET-FED LETTERPRESS ROTARY WITH PRINTING UNITS FOR MULTICOLOR PRINTING AND AT LEAST ONE COATING UNIT

(75) Inventors: Rainer Stamme, Augsburg; Ulrich Jung, Limburg; Franz-Peter Richter, Fränkisch-Crumbach; Dietmar Stahl, Obertshausen, all of (DE)

(73) Assignee: MAN Roland Druckmaschinen AG (DE)

( * ) Notice: Subject to any disclaimer, the term of this patent is extended or adjusted under 35 U.S.C. 154(b) by 0 days.

(21) Appl. No.: 09/622,762

(22) PCT Filed: Feb. 15, 1999

(86) PCT No.: PCT/EP99/00980

§ 371 Date: Sep. 28, 2000

§ 102(e) Date: Sep. 28, 2000

(87) PCT Pub. No.: WO99/42291

PCT Pub. Date: Aug. 26, 1999

(30) Foreign Application Priority Data

Feb. 21, 1998 (DE) ..... 198 07 505

(51) Int. Cl.[7] ..... B41F 35/00
(52) U.S. Cl. ..... 101/425; 101/350.5; 101/401.1
(58) Field of Search ..... 101/177, 170, 101/148, 350.5, 423, 424, 425, 401.1

(56) References Cited

U.S. PATENT DOCUMENTS 3,986,450 * 10/1976 Zimmer ..... 101/425
3,992,994 * 11/1976 Mitter ..... 101/425
4,054,685 * 10/1977 Giori ..... 101/425
5,046,416 * 9/1991 Freyer et al. ..... 101/425
5,099,758 * 3/1992 Hassler et al. ..... 101/424
5,277,111 * 1/1994 Uribe et al. ..... 101/425
5,365,849 * 11/1994 Spiegel ..... 101/423
5,615,612 * 4/1997 Guba et al. ..... 101/425
5,622,112 * 4/1997 Kusch ..... 101/425
5,732,631 * 3/1998 Walther et al. ..... 101/424
6,047,640 * 4/2000 Murakawa ..... 101/350.5
6,070,528 6/2000 Fleischmann et al. .
6,136,375 * 10/2000 Bressler et al. ..... 101/401.1

FOREIGN PATENT DOCUMENTS

0813957 A2 12/1997 (EP) .
97/24233 7/1997 (WO) .

* cited by examiner

*Primary Examiner*—Eugene Eickholt
(74) *Attorney, Agent, or Firm*—Leydig, Voit & Mayer, Ltd.

(57) ABSTRACT

The invention relates to a sheet-fed rotary printing machine with printing units for multi-color printing and with at least one coating unit. The object of the invention is, inter alia, to provide a sheet-fed rotary printing machine of the type described in the introduction, in which at least one coating unit can be used more universally and set-up times are reduced. This is achieved in that the coating unit 2, 3 is formed from an impression cylinder 10, a form cylinder 12 and a metering system 14 with a screened applicator roller 13. The applicator roller 13 has a circular segment congruent to the cylinder pit of the form cylinder 12, is at least the same size as the form cylinder 12 and can be imaged as a rough intaglio printing form.

38 Claims, 6 Drawing Sheets

SHEET-FED LETTERPRESS ROTARY WITH PRINTING UNITS FOR MULTICOLOR PRINTING AND AT LEAST ONE COATING UNIT

FIELD OF THE INVENTION

A sheet-fed rotary printing machine of this type is known from EP 0620115 B1. At least two varnishing units are provided for the in-line coating of printing materials. In this case, the varnishing unit, which precedes in the sheet running direction, is designed as a flexographic printing unit with a forme cylinder which carries a letterpress printing form and which is in contact with the sheet-guiding impression cylinder, with a screened applicator roller for inking (coating), which is in contact with the forme cylinder, and with a throw-on chamber doctor which is connected to a feed pump for the supply of coating fluid and to a suction pump for the return of coating fluid.

One disadvantage of this is that, for renewed coating orders, the printing form on the forme cylinder has to be exchanged and, if appropriate, the original screen roller must be exchanged for a screen roller having a different scoop volume. The change of the printing form is complicated to carry out either manually or in an automated manner and, furthermore, stoppage times occur on the printing machine as a result of the resetting work.

DE 195 03 951 A1 disclosed a method and an apparatus for intaglio printing. According to this, the depressions (wells) of a rough intaglio printing form can be uniformly filled, as a basic screen, by an applicator device by means of a liquefiable substance, subsequently the substance material can be stripped away from the depressions in conformity with the image by means of an image-dot transfer device, and intaglio printing form, screened in this way in conformity with the image, can be inked by means of an inking system, so that intaglio printing can thereafter be carried out. After the printing operation, the intaglio printing form can be regenerated to the rough intaglio printing form and the depressions can subsequently be filled again.

OBJECTS AND SUMMARY OF THE INVENTION

Accordingly, in view of the foregoing, an object of the present invention is to provide a sheet fed rotary printing machine having a printing unit for multi-colour printing and a coating unit which avoids the above-mentioned problems with such printing machines, can be used more universally with its printing units and coating unit and which substantially reduces set-up times.

The solution according to the invention makes it possible, in addition to producing a multi-colour print, to apply at least one in-line coating to a printing material. In this case, in addition to the known inking of the printing material by the metering of the quantity of coating fluid, the in-line coating can be carried out as image-conforming (subject-related) preferably in-line imaging with in-line coating.

For this purpose, the sheet-fed rotary printing machine, preferably controlled by means of a control desk, has, in addition to the printing units, at least one coating unit which is formed, at least, from a sheet-guide cylinder, a forme cylinder and a metering system, with a screened applicator roller as a rough intaglio printing form or with the forme cylinder itself as a rough intaglio printing form.

Furthermore, the solution according to the invention allows in-line coating in the coating unit and makes it possible to produce the intaglio printing form on the applicator roller or the forme cylinder outside the sheet-fed rotary printing machine in a separate device. In this case, a separate device of this type may also be arranged separately at or on a printing unit and/or a coating unit. The exchange of the applicator roller or forme cylinder between the coating unit and the separate device for producing the intaglio printing form can be carried out manually or preferably by means of a handling system. Alternatively, this principle may be transferred to a printing unit for multi-colour printing, if this printing unit has a forme cylinder as an intaglio printing form (direct intaglio printing) or an applicator roller as an intaglio printing form (indirect intaglio printing). The separate device for producing the intaglio printing form can thus also be arranged at or on at least one printing unit for multi-colour printing.

For example, the separate device for producing the intaglio printing form may be arranged above the coating unit on the latter. The separate device is assigned, adjacent to it, as a handling system, for example an industrial robot which extracts the applicator roller or the forme cylinder from the mountings of the coating unit and which supplies the said applicator roller or forme cylinder to the separate device for producing the intaglio printing form and returns it from the separate device into the respective mounting.

In a further design, the separate device for producing the intaglio printing form, furthermore, is assigned a magazine as a roller/cylinder store. In this case, the handling system again extracts the applicator roller or forme cylinder from the mountings and supplies the applicator roller or forme cylinder to the magazine and returns it from the magazine to the respective mounting. In this case, the production of the intaglio printing form on the applicator roller or the forme cylinder can be achieved in the magazine by means of the separate device.

The magazine may also be used, in the simplest form, as roller/cylinder mounting for the temporary safekeeping of the applicator roller and/or forme cylinder. Furthermore, the magazine may also be designed for receiving a plurality of applicator rollers and/or forme cylinders. The occupancy of the storage locations (for rollers/cylinders) in the magazine and/or the activation of the handling system and of the separate device for producing the intaglio printing form can preferably be controlled from a coupled control desk. In this case, the magazine also ensures a roller/cylinder sequence, such as is required at the separate device for producing the intaglio printing form and at the safekeeping position. The handling system, magazine and separate device are not restricted to being assigned to a coating unit, but an arrangement of these subassemblies may also be implemented at or on, in particular above at least one printing unit.

Several designs are suitable for a metering system. Thus, in a first design, a metering roller is assigned to the screened applicator roller (as a two-roller unit) and the coating fluid is supplied into the roller nip thus formed. In a second design, the screened applicator roller is assigned a chamber doctor which is coupled to a circulation system for the coating fluid. Finally, in a third design, at least one scoop roller is assigned to the screened applicator roller. The coating fluid is scooped from a supply tank and conveyed to the roller nip.

The screened applicator roller itself is designed as a rough intaglio printing form with depressions (wells) and webs as a basic screen. With regard to a single-sized forme cylinder of the coating unit, this screened applicator roller is designed at least with the same diameter or larger. Preferably for partially recurring printing orders, the diameter of the applicator roller is designed to correspond to an even-numbered fraction of a single-sized forme cylinder.

The forme cylinder has a covering, which receives the coating fluid, and, preferably, a cylinder pit. In a circular segment of the part circumference, the screened applicator roller has an evenly curved surface in the roller casing essentially congruently to the cylinder pit of the forme cylinder, this part circumference being capable of being executed in two designs.

In a first design, the part circumference, which is level with the top edge of the webs, is a smooth surface (without a basic screen), and, in a second design, the basic screen already described is provided, which is filled completely with a material in order to achieve an even surface.

In one design, the screened applicator roller is assigned a dispensing device for filling the depressions of the basic screen with a liquefiable substance, a stripping device for the image-conforming (subject-related) removal of the substance from the depressions of the basic screen and a regenerating device for regenerating the intaglio printing form back to the basic screen (rough intaglio printing form). In this design, the coating unit can be used for in-line imaging and in-line coating.

In a further design, the screened applicator roller can be imaged according to the coating subject outside the coating unit by means of the abovementioned regenerating device, dispensing device and stripping device and can subsequently be inserted into the coating unit so as to be assigned to the forme cylinder and metering system.

A first advantage of the invention is based on the fact that there is no need to change the printing forms on the forme cylinder in the case of the in-line imaging of the screened applicator roller and subsequent in-line coating in the coating unit. Consequently, set-up times can be reduced and the coating unit can be used more universally. If the imaging of the screened applicator roller takes place outside the coating unit, it is particularly advantageous that the intaglio printing form can be produced, without the printing machine having any stoppage times, and, subsequently, it is necessary merely to exchange or insert the applicator roller at the bearing points of the coating unit.

Further advantages of the invention are based on the fact that, in the case of coating in conformity with the image, the coating fluid can be applied to the printing material in a format-related manner. The build-up of excess coating fluid on rollers or cylinders can thereby be avoided. The desired imaging can be regenerated at any time. If the coating fluid nevertheless builds up, for example in the case of quick-setting coating fluids, it can be removed automatically. The possible setting of the coating fluid on the screened applicator roller can therefore be avoided by clearing the basic screen.

Furthermore, as a result of coating in conformity with the image, different gloss effects or degrees of glossing can be achieved within a printing or coating subject, for example by partially differing layer thicknesses being produced. Moreover, for example, uniform, graded and/or different coating thicknesses and part coatings can be achieved in the circumferential direction and transverse direction.

The depressions of the screened applicator roller can be returned, at least periodically, to the basic screen (rough intaglio printing form) by the use of the regenerating device, dispensing device and stripping device.

The coating unit makes it possible to process different coating fluids, such as, for example, flexographic printing ink, pigment-containing fancy printing ink and dispersion varnish, in particular coating fluids on an aqueous base being used.

The coating unit can be operated in the direct or indirect intaglio printing mode. The printing units for multi-colour printing are designed as offset printing units and/or direct or indirect intaglio printing units, preferably flexographic printing units.

These and other features and advantages of the invention will be more readily apparent upon reading the following description of preferred exemplary embodiments of the invention and upon reference to the drawings wherein:

While the invention will be described and disclosed in connection with certain preferred embodiments and procedures, it is not intended to limit the invention to those embodiments. Rather it is intended to cover all such alternative embodiments and modifications as fall within the spirit and scope of the invention.

DETAILED DESCRIPTION OF PREFERRED EMBODIMENTS

Figure 1:
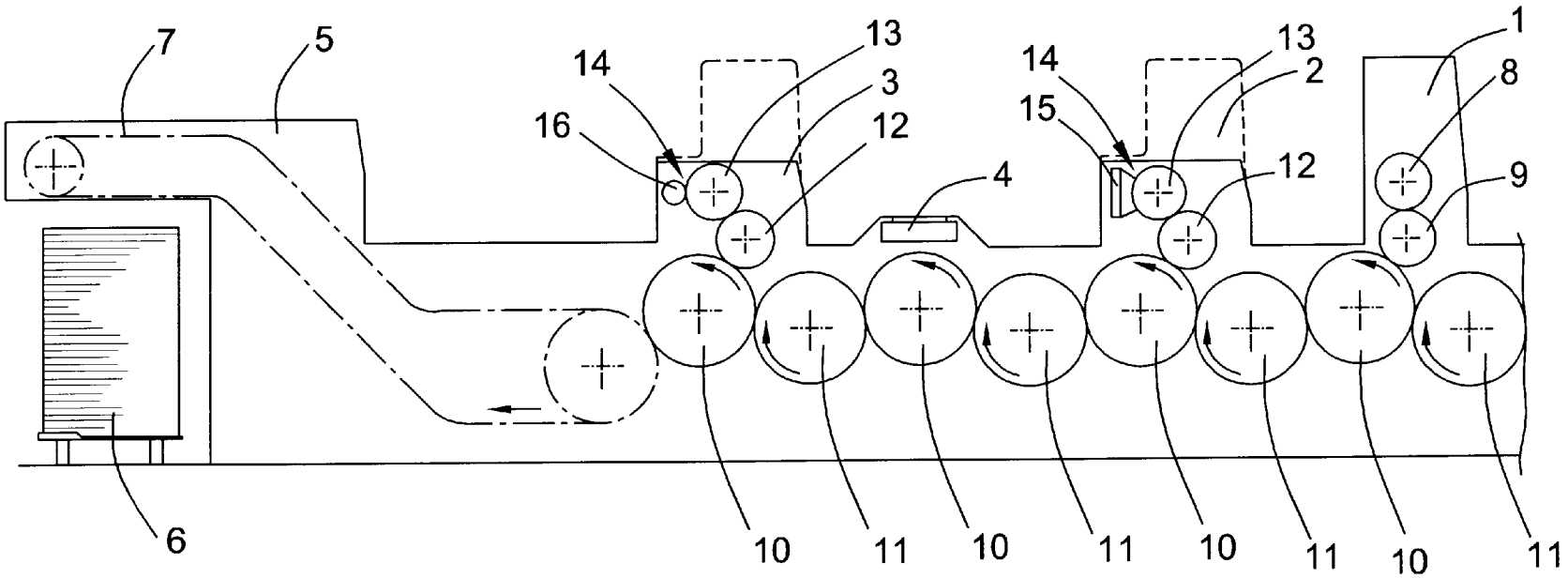
FIG. 1 schematic side view of an exemplary sheet-fed rotary printing machine with two coating units and different metering systems FIG. 2 schematic side view of an exemplary sheet-fed rotary printing machine with two coating units and identical metering systems FIG. 3 schematic partial side view of a coating unit with a metering system consisting of a chamber doctor and of a screened applicator roller FIG. 4 schematic partial side view of a coating unit with a metering system consisting of a metering roller and of a screened applicator roller FIG. 5 schematic partial side view of a coating unit with a metering system consisting of a scoop roller and of the screened applicator roller FIG. 6 schematic drawing showing" the production of an intaglio printing form on a screened applicator roller, with the steps a) filling the depressions (wells) b) clearing the depressions (wells) in conformity with the image c) regenerating the depressions (wells)
Figure 2:
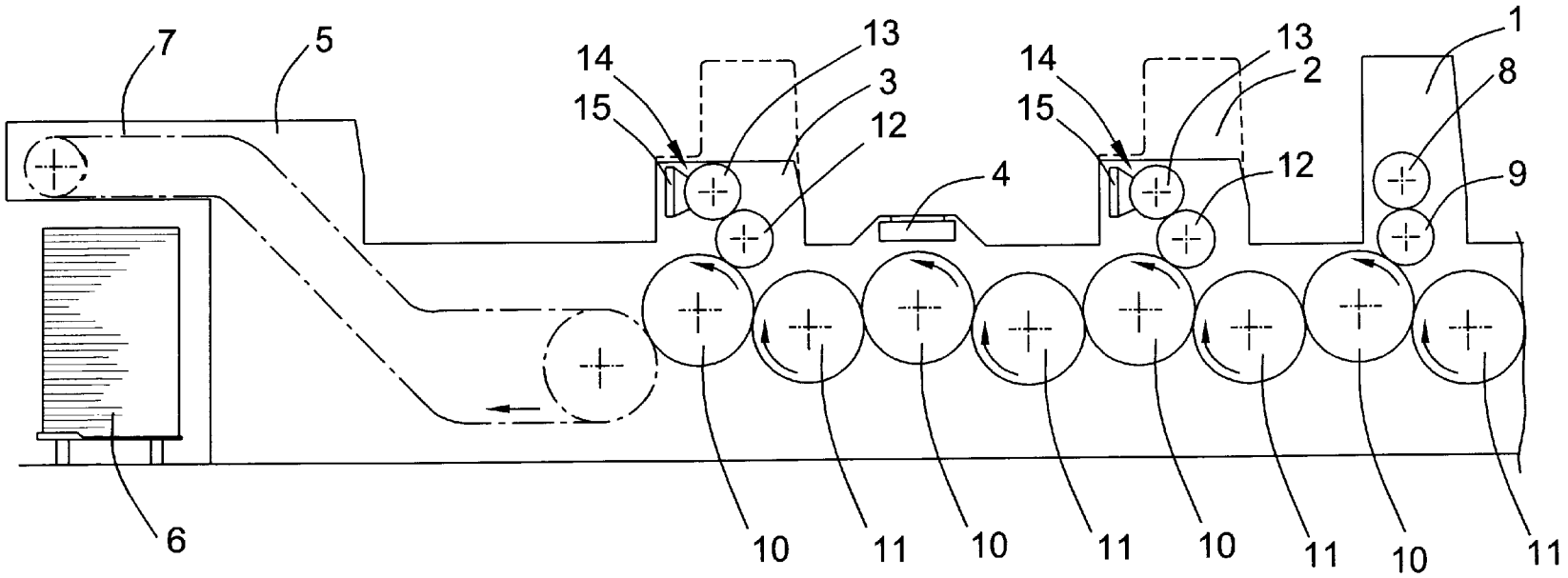

FIGS. 1 and 2 illustrate variants of sheet-fed rotary printing machines. A printing machine is given an in-line design with a plurality of printing units 1, preferably offset printing units, the printing units 1 being followed by a first coating unit 2 and a second coating unit 3 in the conveying direction of the sheet-like printing materials. A dryer unit 4 is arranged between the coating units 2, 3 for drying the printing materials to be processed. The second coating unit 3 is followed by a delivery 5 which is formed, inter alia, by rotating conveyor systems 7 which deposit the sheets on to a delivery stack 6.

A printing unit 1, as an offset unit, consists essentially of a plate cylinder 8, a rubber-blanket cylinder 9 and a sheet-guiding impression cylinder 10. The plate cylinder 8 is assigned an inking unit, and, if appropriate, furthermore, the plate cylinder 8 has adjacent to it a dampening unit which will not be discussed in any more detail here. A sheet-guiding transfer cylinder 11 for transporting the printing materials is arranged in each case between the printing units 1 and the coating units 2, 3 and dryer unit 4.

The first coating unit 2 is designed as a varnish unit, for example for the processing of dispersion varnish with pigments on an aqueous base, and consists of the impression cylinder 10, of a forme cylinder 12 which can be brought into contact with the impression cylinder 10 and carries a covering 21 and which has a cylinder pit 22, and of a first metering system 14. The metering system 14 is formed by a screened applicator roller 13, capable of being brought into contact with the forme cylinder 12, and a chamber doctor 15 operatively connected to this applicator roller 13.

The second coating unit 3 is likewise designed as a varnish unit, for example for the processing of dispersion varnish on an aqueous base, and consists, again, of the impression cylinder 10, of the forme cylinder 12 which can be brought into contact with the impression cylinder 10 and carries the covering 21 and which has a cylinder pit 22, and of a second metering system 14. This metering system 14 is formed by a screened applicator roller 13, capable of being brought into contact with the forme cylinder 12, and a metering roller 16 as a two-roller unit. The metering systems 14 can each be coupled to a separately controllable circuit system for the circulation of coating fluids.

The screened applicator roller 13 is a rough intaglio printing form with a basic screen having depressions (wells) and webs. In this case, the applicator roller 13 is designed with a diameter equal to that of the forme cylinder 12. Furthermore, the circumference of the applicator roller 13 has an evenly curved surface in the roller casing, essentially congruently to the cylinder pit 22 of the forme cylinder 12, in a circular segment 23 of the part circumference. In addition to the congruent design of the circular segment 23 itself, the layout of the circular segment 23 is also congruent to the cylinder pit 22 when the applicator roller 13 and forme cylinder 12 have the same speeds. The forme cylinder 12 carries a compressible covering 21 which preferably has properties which accept the coating fluid to be processed.

In a first design, within at least one coating unit 2, 3, the applicator roller 13 is assigned circumferentially:

- a dispensing device 19 for filling the depressions of the rough intaglio printing form (basic screen) of the applicator roller 13 with a liquefiable substance 25,
- a stripping device 20, for example a laser 27, for the image-conforming removal of this substance 25 from the depressions and therefore for producing the intaglio printing form, and
- a regenerating device 18 for regenerating (erasing the remaining substance 25) the applicator roller 13 to the rough intaglio printing form (basic screen) by means of cleaning fluid 29.

In a second design, the dispensing device 19, stripping device 20 and regenerating device 18 are arranged outside the coating unit 2 and/or 3. In this case, the screened applicator roller 13 can be imaged outside the respective coating unit 2, 3 and can subsequently be inserted as an intaglio printing form into the mountings (roller mountings) of the corresponding coating unit 2, 3.

Alternatively, the outside-imaged intaglio printing form of the screened applicator roller 13 is designed as a sleeve and can be axially drawn on to and off a basic roller body by the sleeve technique. In this case, the applicator roller 13, with the intaglio printing form as a sleeve, can, again, be inserted into the roller mountings of the respective coating unit 2, 3 or the intaglio printing form, as a sleeve, can be drawn on to and off a fixed basic roller body within the coating unit 2, 3.

Alternatively, an intaglio printing form already imaged or still to be imaged can be tensioned as a plate on the applicator roller 13. In this case, a tension pit is arranged congruently to the cylinder pit 22 of the forme cylinder 12 and can be covered in such a way that, in a similar way to the circular segment 23, the cover is an evenly curved surface in the roller casing. In a development, the tension pit can be filled with a liquefiable substance 25. The substance 25 can be removed again by means of the regenerating device 18.

Figure 3:
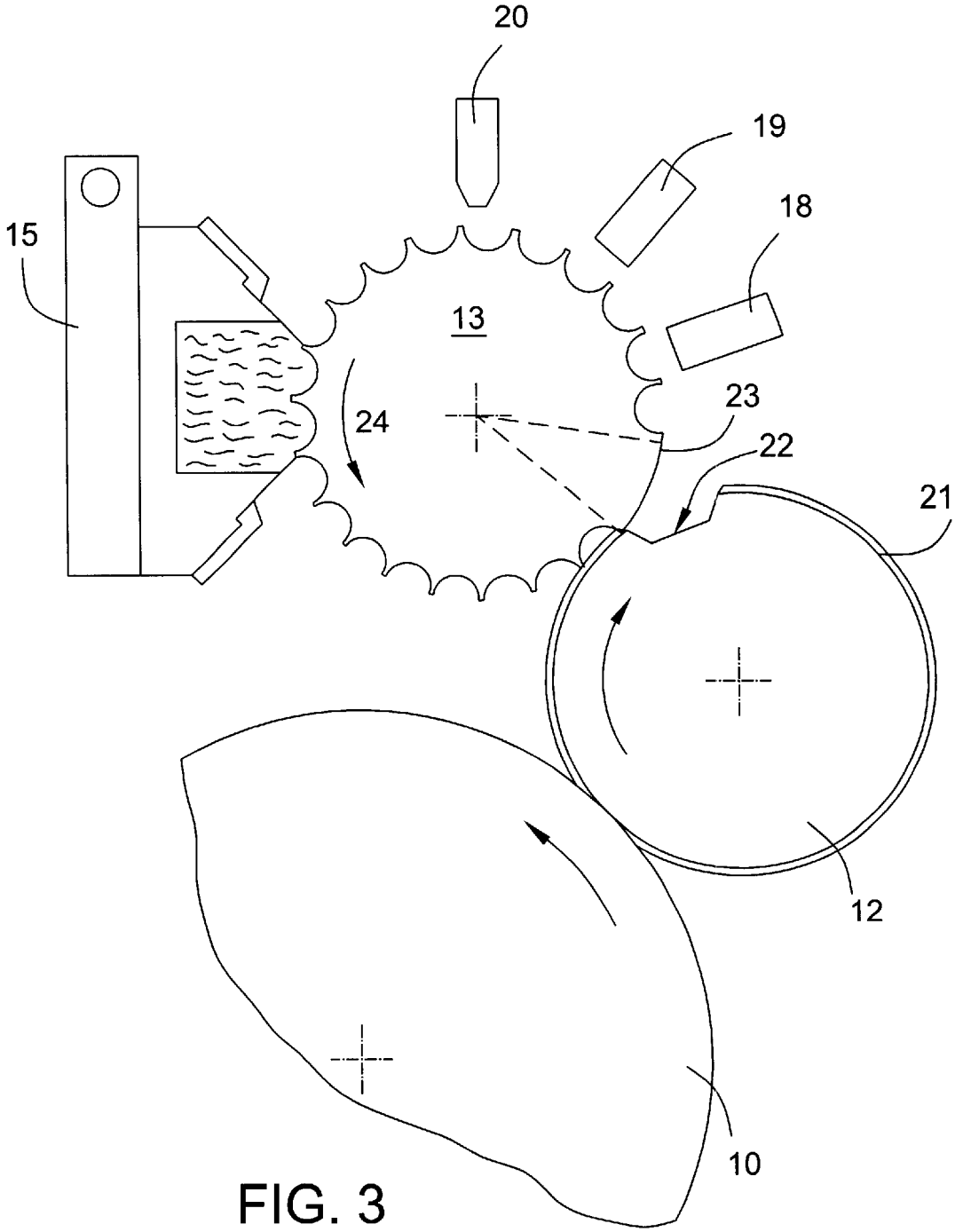
Figure 4:
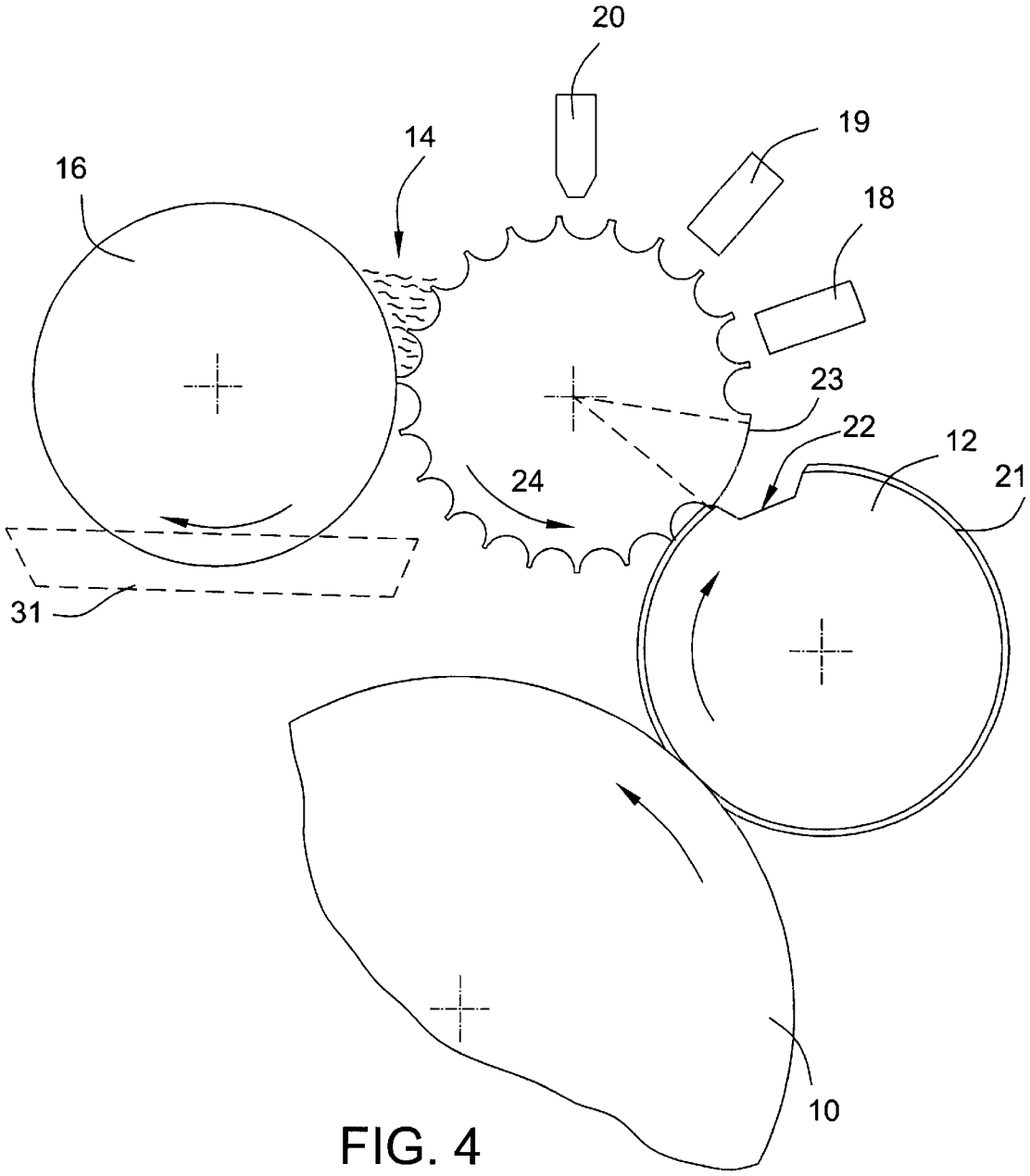
Figure 5:
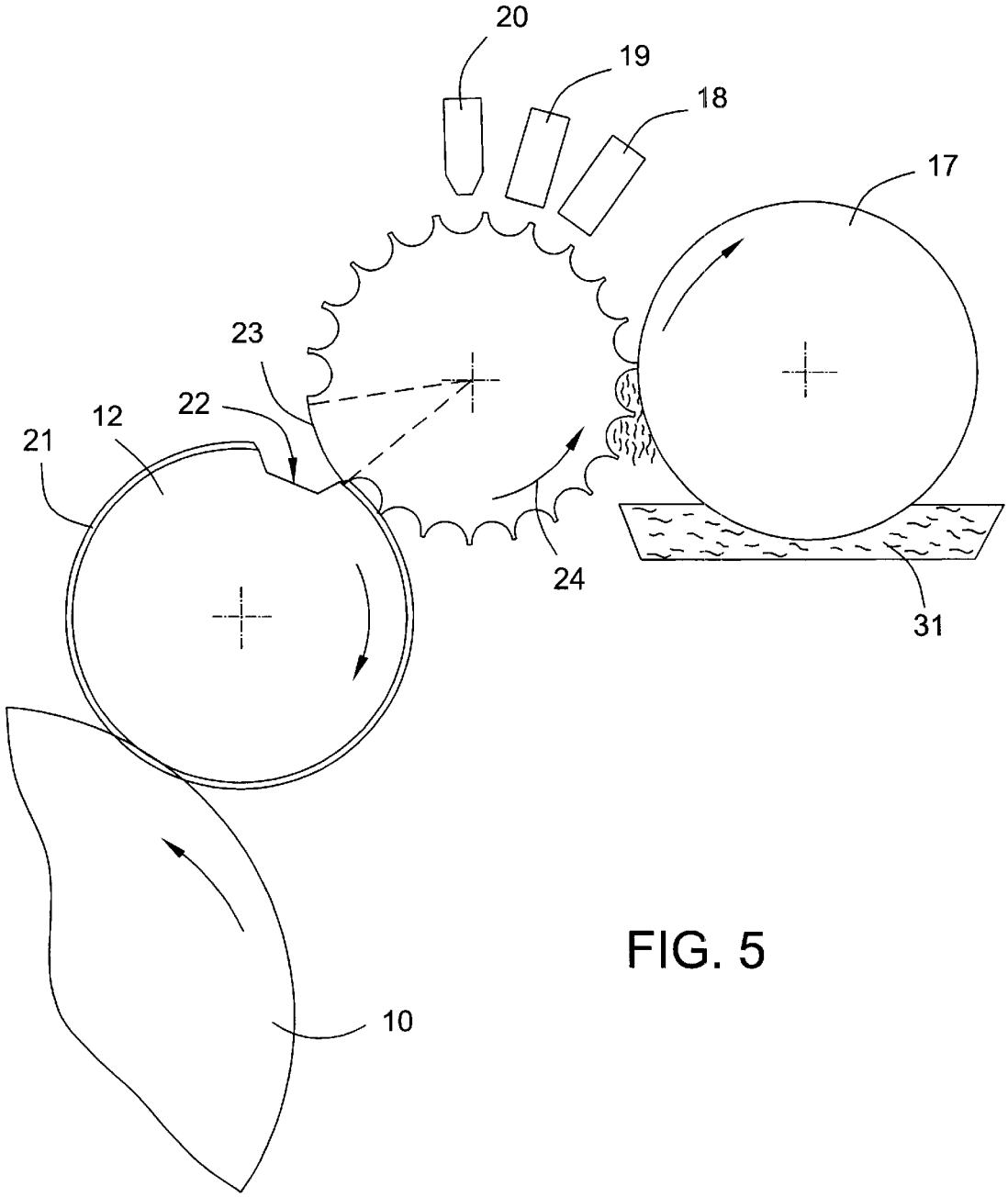

FIGS. 3 to 5 show different versions of the metering systems 14 which are to be selectively assigned individually to the coating units 2 and/or 3. Furthermore, these metering systems 14 are also suitable for use in printing units 1 for multi-colour printing, which are designed as flexographic printing units.

According to FIG. 3, the chamber doctor 15 is illustrated as being in contact with the screened applicator roller 13. The coating fluid is supplied into the housing interior of the chamber doctor 15 and is charged from it in a circuit system with slight excess pressure. The forme cylinder 12 carries, as a compressible covering 21, an elastic full-surface preferably flexible letterpress printing form (without relief). The regenerating device 18, dispensing device 19 and stripping device 20 are assigned to the applicator roller 13 downstream of the point of contact with the forme cylinder 12 in the direction of rotation 24 of the applicator roller 13.

According to FIG. 4, the metering system 14 is formed by the screened applicator roller 13 and a metering roller 16 operating on the nip-roller principle. The two-roller unit thus formed receives from above the coating fluid which is supplied to the roller nip (applicator roller 13/metering roller 16), excess coating fluid being capable of being discharged on the end face. In this case, the forme cylinder 12 carries, as a compressible covering 21, a planographic printing form, for example a rubber blanket, having properties which are described in more detail. The arrangement of the regenerating device 18, dispensing device 19 and stripping device 20 are similar to that of FIG. 3. Alternatively, a tank 31 may also be assigned to the metering roller 16, so that the latter performs the function of a scoop roller. It is therefore unnecessary to supply coating fluid to the roller nip from above.

Finally, FIG. 5 illustrates a metering system 14 which has a scoop roller 17 which dips into a tank 31 having coating fluid and which is in contact with the screened applicator roller 13. The forme cylinder 12 carries a printing film as a covering 21.

The coverings 21 used are not restricted to the corresponding metering system 14.

In order to avoid or reduce the possibility the printing ink from preceding printing units 1 will split off back onto the covering 21, the covering 21 has properties which repel the abovementioned printing ink, but accept the coating fluid. Alternatively, the forme cylinder 12, together with its covering 21, is assigned a washing device for cleaning the covering 21. Preferably, this washing device is a traversing spray-washing device with suction extraction, which, preferably during the coating process, keeps the covering 21 free of split-back printing ink or cleans or at least wets the said covering.

Within the sheet-fed rotary printing machine, at least one coating unit 2 or 3 is operatively connected to the printing units 1 for multi-colour printing. In this case, these printing units 1 are designed as offset printing units and/or flexographic printing units.

This results in the following arrangements:

- at least one coating unit 2, 3 can be arranged between the printing units 1 for multi-colour printing (offset printing units and/or flexographic printing units), at least one coating unit 2, 3 can be arranged upstream of the printing units 1 for multi-colour printing (offset printing units and/or flexographic printing units), and at least one coating unit 2, 3 can be arranged downstream of the printing units 1 for multi-colour printing (offset printing units and/or flexographic printing units).

In a further design, not shown, the forme cylinder 12, as a rough intaglio printing form with a basic screen having depressions, is integrated into the metering system 14. In this case, the metering system 14 does not require an applicator roller 13, but is designed selectively as a chamber doctor 15, metering roller 16 or scoop roller 17 so as to be capable of being thrown on to the forme cylinder 12. The forme cylinder 12 has at least one single-sized diameter in relation to the adjacent impression cylinder 10. Arranged so as to be adjacent to this forme cylinder 12 are a dispensing device 19 for filling the depressions of the basic screen with a liquefiable substance 25, a stripping device 20 for the image-conforming removal of this substance 25 from the depressions for imaging purposes and a regenerating device 18 for regenerating the depressions of the forme cylinder 12 back to the rough intaglio printing form. In this case, the forme cylinder 12 has a cover capable of being moved into the cylinder pit 22, and the impression cylinder 10 carries circumferentially sheet-conveying means which project from the enveloping circle.

The screened applicator roller 13, as a rough intaglio printing form, or the forme cylinder 12, as a rough intaglio printing form, can, in one version, be extracted from the coating unit 2, 3 or inserted again. In this case, the dispensing device 19, stripping device 20 and regenerating unit 18 are arranged, as a device 18, 19, 20, outside the coating unit 2, 3 and/or outside a printing unit 1 for multi-colour printing, which is designed as a flexographic printing unit. In this device 18, 19, 20, an intaglio printing form screened in conformity with the image can be produced on the applicator roller 13 or the forme cylinder 12 by the assignment of the extracted applicator roller 13 or forme cylinder 12.

In a further design, at least one printing unit 1 for multi-colour printing within the sheet-fed rotary printing machine is designed with at least one coating unit 2, 3 and with a metering system 14 as a flexographic printing unit, in such a way that this printing unit 1, as a flexographic printing unit, possesses a screened applicator roller 13 as a rough intaglio printing form with a basic screen having depressions. This applicator roller 13 is designed with an evenly curved surface in the roller casing, essentially congruently to the cylinder pit 22 of the forme cylinder 12, in a circular segment 23 of the part circumference. The forme cylinder 12 carries a covering 21 for accepting a flexographic printing ink. This applicator roller 13 is assigned a dispensing device 19 for filling the depressions of the basic screen with a liquefiable substance 25, a stripping device 20 for the image-conforming removal of this substance 25 from the depressions for imaging purposes and a regenerating device 18 for regenerating the depressions of the applicator roller 13 back to the rough intaglio printing form.

Alternatively, at least one printing unit 1 for multi-colour printing within the sheet-fed rotary printing machine is designed with at least one coating unit 2, 3 and with a metering system 14 as a flexographic printing unit, in such a way that this printing unit 1, as a flexographic printing unit, has a forme cylinder 12 as a rough intaglio printing form with a basic screen having depressions. This forme cylinder 12 has at least a single-sized diameter in relation to the sheet-guiding impression cylinder 10. This forme cylinder 12 is assigned a dispensing device 19 for filling the depressions of the basic screen with a liquefiable substance 25, a stripping device 20 for the image-conforming removal of this substance 25 from the depressions for imaging purposes and a regenerating device 18 for regenerating the depressions of the forme cylinder 12 back to the rough intaglio printing form.

The mode of operation is essentially as follows: the coating units 2, 3 can be arranged individually or severally downstream of, upstream of or else between the printing units 1 for multi-colour printing. This also includes printing units 1 as verso printing units and/or printing units 1 with turning devices which precede in the sheet-conveying direction. Thus, for example, in a coating unit 2 (or 3) preceding the first printing unit 1 in the sheet-conveying direction, full-surface or partial covering coating of the printing material can be achieved. In the case of a coating unit 2 (or 3) arranged between the printing units 1, for example, full-surface covering coating of one side of the printing material can be carried out, and, subsequently, a turn of the sheet can be executed, with the latter subsequently being fed into further printing units 1. In the case of coating units 2, 3 located downstream of the printing units 1, for example, in the first coating unit 2, full-surface or partial varnishing (with dispersion varnish on an aqueous base) can -be applied to the printing material, and, subsequently, in the second coating unit 3, partial further varnishing, for example by means of gold varnish, which is embedded in a floating manner into the dispersion varnish, can be applied.

In order to coat the printing material, the coating fluid is supplied to the respective metering system 14 used. The screened applicator roller 13, to be inserted in the respective coating unit 2, 3, is imaged inside or outside the machine. In this case, the screened applicator roller 13, preferably as a ceramic roller, constitutes the rough intaglio printing form as a basic screen.

Figure 6:
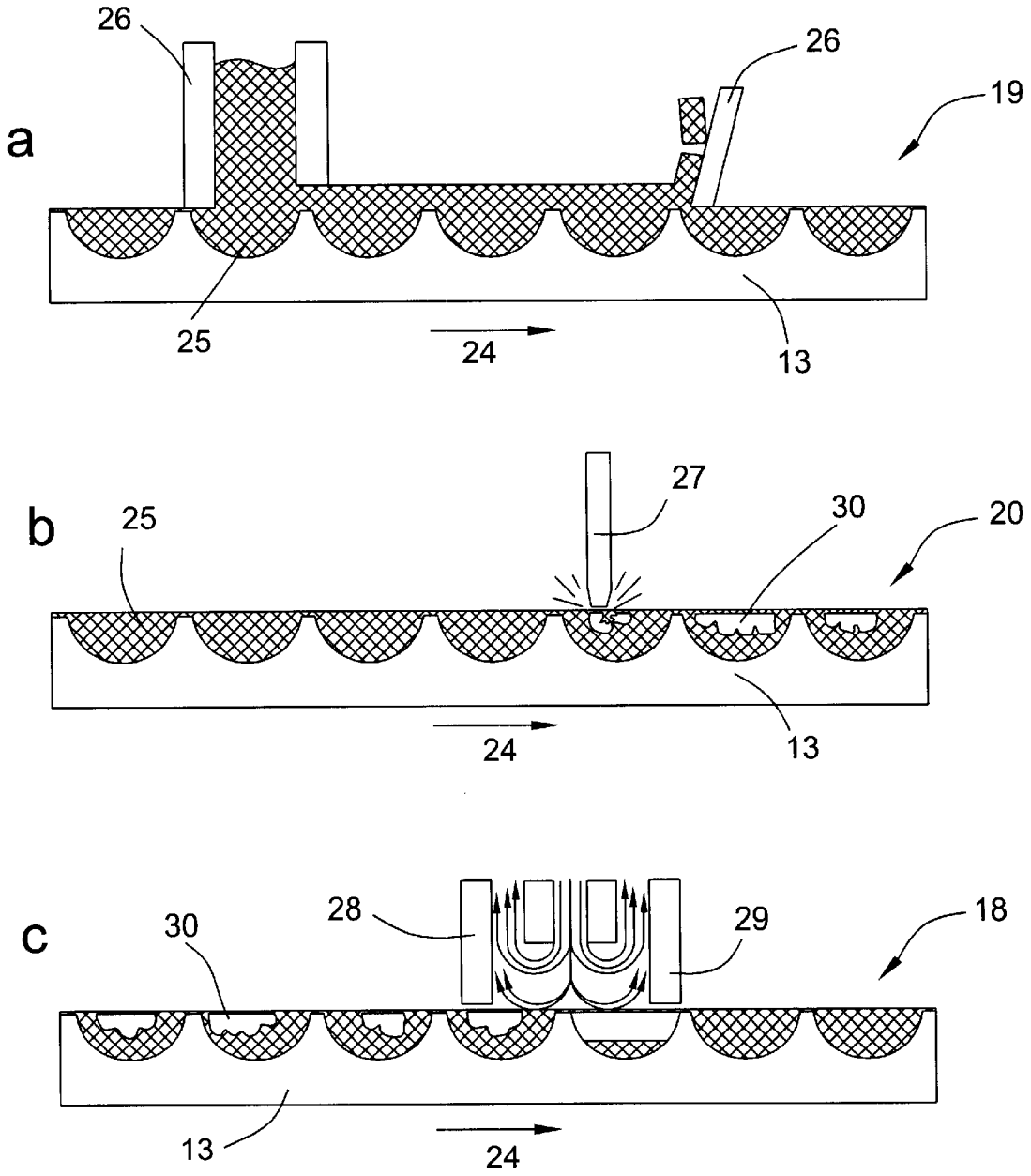

Imaging takes place in the following steps in the direction of rotation 24 of the applicator roller 13 according to FIG. 6. At the dispensing device 19, the depressions of the rough intaglio printing form are filled with the liquefiable substance 25. The dispensing device 19 has, in the direction of rotation 24, wiping elements 26 which wipe off the excess substance 25 on the surface of the webs. The substance 25 sets. The stripping device 20 contains, inter alia, the laser 27 which, depending on the coating subject, clears a stripped-off portion 30 from the substance 25 in conformity with the image, so that the actual intaglio printing form is then obtained. This intaglio printing form on the screened applicator roller 13 is subsequently filled with coating fluid by the metering system 14, and the coating fluid is transferred onto the covering 21 of the forme cylinder 12 in the appropriate quantity and according to the subject and, in the printing nip, is transferred onto the printing material guided on the impression cylinder 10.

When the intaglio printing form is no longer required or it is necessary to regenerate the latter, a cleaning fluid 29 is applied to the substance 25 by means of the regenerating device 18, the said cleaning fluid removing the substance 25 from the depressions by suction extraction (including the cleaning fluid 29) within a housing 28. The screened applicator roller 13 is again available as a rough intaglio printing form and can be imaged once more.

List of reference symbols

1 Printing unit
2 Coating unit
3 Coating unit
4 Dryer unit

5 Delivery
6 Delivery stack
7 Conveyor system
8 Plate cylinder
9 Rubber-blanket cylinder
10 Impression cylinder
11 Transfer cylinder
12 Forme cylinder
13 Screened applicator roller
14 Metering system
15 Chamber doctor
16 Metering roller
17 Scoop roller
18 Regenerating device
19 Dispensing device
20 Stripping device
21 Covering
22 Cylinder pit
23 Circular segment
24 Direction of rotation
25 Liquefiable substance
26 Wiping element
27 Laser
28 Housing
29 Cleaning fluid
30 Stripped-off portion
31 Tank

What is claimed is:

1. A sheet-fed rotary printing machine comprising:

printing units for multi-colour printing, and a coating unit, the coating unit comprising:

a sheet-guide cylinder, a form cylinder which carries a cover for accepting a coating fluid, and a metering system including a screened applicator roller defining a rough intaglio printing form with a basic screen having depressions, a portion of a circumferential surface of the applicator roller having an evenly curved surface in a roller casing which is substantially congruent to a cylinder pit of the form cylinder, a dispensing device for imaging the applicator roller by filling the depressions of the basic screen with a liquefiable substance, a stripping device for the image-conforming removal of the liquefiable substance from the depressions, and a regenerating device for regenerating the depressions of the applicator roller so as to return the depressions to the rough intaglio printing form.

2. The sheet-fed rotary printing machine according to claim 1, wherein the applicator roller has a diameter equal to a single-sized form cylinder.

3. The sheet-fed rotary printing machine according to claim 1, wherein the applicator roller has a that corresponds to an even-numbered division of a single-sized form cylinder.

4. The sheet-fed rotary printing machine, according to claim 1, wherein the covering of the form cylinder is a compressible planographic printing form.

5. The sheet-fed rotary printing machine according to claim 1, wherein the covering of the form cylinder is an elastic full-surface letterpress printing form.

6. The sheet-fed rotary printing machine according to claim 1, wherein the covering of the form cylinder is a printing film.

7. The sheet-fed rotary printing machine according to claim 1, wherein the covering of the form cylinder has a surface which repels printing ink and accepts coating fluid.

8. The sheet-fed rotary printing machine according to claim 1, wherein the dispensing device, the stripping device and the regenerating device are assigned to the screened applicator roller within the coating unit.

9. The sheet-fed rotary printing machine according to claim 1, wherein the form cylinder has a corresponding washing device.

10. The sheet-fed rotary printing machine according to claim 9, wherein the washing device is a spray-washing device with suction extraction.

11. The sheet-fed rotary printing machine according to claim 10, wherein the spray-washing device has a coating mode in which the spray-washing device cleans or wets the covering of the form cylinder by a traversing motion.

12. The sheet-fed rotary printing machine according to claim 1, wherein the applicator roller includes a basic roller body and a sleeve which carries the rough intaglio printing form and can be pushed in an axial direction on to the basic roller body.

13. The sheet-fed rotary printing machine according to claim 1, wherein the metering system includes a chamber doctor.

14. The sheet-fed rotary printing machine according to claim 1, wherein the metering system includes a metering roller.

15. The sheet-fed rotary printing machine according to claim 1 wherein the metering system includes a scoop roller.

16. The sheet-fed rotary printing machine according to claim 1, wherein the screened applicator roller can be removed from or inserted into the coating unit and the dispensing device, stripping device and regenerating unit are arranged as a separate device outside the coating unit, and in which an intaglio printing form screened in conformity with the image can be produced on the applicator roller or the form cylinder.

17. The sheet-fed rotary printing machine according to claim 1, wherein the coating unit is arranged between the printing units for multi-colour printing.

18. The sheet-fed rotary printing machine according to claim 1, wherein the coating unit is located upstream from the printing units for multi-colour printing in the sheet-fed rotary printing machine.

19. The sheet-fed rotary printing machine according to claim 1 wherein the coating unit is located downstream of the printing units for multi-colour printing in the sheet-fed rotary printing machine.

20. The sheet-fed rotary printing machine according to claim 1, wherein the printing units for multi-colour printing are offset printing units.

21. The sheet-fed rotary printing machine according to claim 1, wherein the printing units for multi-colour printing are flexographic printing units.

22. The sheet-fed rotary printing machine according to claim 1, wherein the printing units for multi-colour printing are offset printing units and flexographic printing units.

23. A sheet-fed rotary printing machine comprising:

a printing unit for multi-colour printing, and a coating unit, the coating unit comprising:

a sheet-guide cylinder, a metering system, a form cylinder integrated into the metering system which defines a rough intaglio printing form with a basic screen having depressions, the form cylinder having at least a single-sized diameter in relation to an adjacent impression cylinder, a dispensing device for imaging the form cylinder by filling the depressions of the basic screen with a liquefiable substance, a stripping device for the image-conforming removal of the liquefiable substance from the depressions, and a regenerating device for regenerating the depressions of the form cylinder so as to return the depressions to the rough intaglio printing form.

24. The sheet-fed rotary printing machine according to claim 23, wherein the metering system includes a chamber doctor.

25. The sheet-fed rotary printing machine according to claim 23 wherein the metering system includes a metering roller. metering system includes a metering roller.

26. The sheet-fed rotary printing machine according to claim 23 wherein the metering system includes a scoop roller.

27. The sheet-fed rotary printing machine according to claim 23, wherein the form cylinder has a moveable cover for a cylinder pit and the impression cylinder carries a sheet-conveying device.

28. The sheet-fed rotary printing machine according to claim 23, wherein the sheet-guide cylinder carries a compressible covering.

29. The sheet-fed rotary printing machine according to claim 23, wherein the form cylinder defining the rough intaglio printing form can be inserted into and removed from the coating unit and the dispensing device, the stripping device and the regenerating unit are arranged as a separate device outside the coating unit in which an intaglio printing form screened in conformity with the image can be produced on the form cylinder.

30. The sheet-fed rotary printing machine according to claim 23, wherein the coating unit is located upstream from the printing unit for multi-colour printing in the sheet-fed rotary printing machine.

31. The sheet-fed rotary printing machine according to claim 23 wherein the coating unit is located downstream of the printing unit for multi-colour printing in the sheet-fed rotary printing machine.

32. The sheet-fed rotary printing machine according to claim 23, wherein the printing unit for multi-colour printing is a offset printing unit.

33. The sheet-fed rotary printing machine according to claim 23, wherein the printing unit for multi-colour printing is a flexographic printing unit.

34. The sheet-fed rotary printing machine according to claim 29 wherein the separate device for producing the intaglio printing form is arranged at or on the coating unit.

35. The sheet-fed rotary printing machine according to claim 34, wherein the separate device is assigned a handling system for extracting the form cylinder from mountings, supplying it to the separate device and returning it into the mountings.

36. The sheet-fed rotary printing machine according to claim 34, wherein the separate device is assigned a magazine as a roller/cylinder store, and the handling system can extract the form cylinder from the mountings, can supply the form cylinder to the magazine and can return the form cylinder from the magazine into the mountings, the production of the intaglio printing form being capable of being carried out on the form cylinder in the magazine by means of the separate device.

37. A sheet-fed rotary printing machine comprising a printing unit for multi-colour printing which is designed as a flexographic printing unit, the printing unit including a screened applicator roller defining a rough intaglio printing form with a basic screen having depressions, a portion of a circumferential surface of the applicator roller having an evenly curved surface in a roller casing which is substantially congruent to a cylinder pit of a form cylinder, a form cylinder which carries a covering for receiving a flexographic printing ink, a dispensing device for imaging the applicator roller by filling the depressions of the basic screen with a liquefiable substance, a stripping device for the image-conforming removal of the liquefiable substance from the depressions, and a regenerating device for regenerating the depressions of the applicator roller so as to return the depressions to the rough intaglio printing form.

38. A sheet-fed rotary printing machine comprising a printing unit for multi-colour printing which is designed as a flexographic printing unit, the printing unit including a form cylinder defining a rough intaglio printing form with a basic screen having depressions, the form cylinder having at least a single-sized diameter in relation to a sheet-guiding impression cylinder, a dispensing device for imaging the form cylinder by filling the depressions of the basic screen with a liquefiable substance, a stripping device for the image-conforming removal of the liquefiable substance from the depressions, and a regenerating device for regenerating the depressions of the form cylinder so as to return the depressions to the rough intaglio printing form.

* * * * *